US012123174B2

(12) United States Patent
Kukuk et al.

(10) Patent No.: US 12,123,174 B2
(45) Date of Patent: Oct. 22, 2024

(54) THROTTLE CONTROL SYSTEM

(71) Applicant: The Charles Machine Works, Inc., Perry, OK (US)

(72) Inventors: Brant Douglas Kukuk, Perry, OK (US); Jacob Harman, Stillwater, OK (US); Christopher Trimble, Stillwater, OK (US); Monty Kyle Hawkins, Perry, OK (US)

(73) Assignee: The Charles Machine Works, Inc., Perry, OK (US)

( * ) Notice: Subject to any disclaimer, the term of this patent is extended or adjusted under 35 U.S.C. 154(b) by 0 days.

(21) Appl. No.: 18/179,175

(22) Filed: Mar. 6, 2023

(65) Prior Publication Data

US 2023/0203788 A1 Jun. 29, 2023

Related U.S. Application Data

(63) Continuation of application No. 16/999,246, filed on Aug. 21, 2020, now Pat. No. 11,608,613.

(60) Provisional application No. 62/889,737, filed on Aug. 21, 2019.

(51) Int. Cl.

| | |
|---|---|
| ***E02F 9/22*** | (2006.01) |
| ***E02F 9/16*** | (2006.01) |
| ***E02F 9/20*** | (2006.01) |

(52) U.S. Cl.

CPC ..... *E02F 9/2253* (2013.01); *E02F 9/166* (2013.01); *E02F 9/2066* (2013.01); *E02F 9/2267* (2013.01); *E02F 9/2285* (2013.01)

(58) Field of Classification Search

CPC ..... E02F 9/2253; E02F 9/166; E02F 9/2066; E02F 9/22697; E02F 9/2285; E02F 5/06; E02F 9/2246

See application file for complete search history.

(56) References Cited

U.S. PATENT DOCUMENTS

| | | | |
|---|---|---|---|
| 3,385,376 | A | 5/1968 | Hobhouse |
| 3,547,216 | A | 12/1970 | Marie |
| 3,708,031 | A | 1/1973 | Janie et al. |
| 4,165,789 | A | 8/1979 | Rogers |
| 4,400,935 | A | 8/1983 | Louis |
| 4,430,846 | A | 2/1984 | Presley et al. |
| 4,510,963 | A | 4/1985 | Presley et al. |
| 4,913,251 | A | 4/1990 | Farr |

(Continued)

FOREIGN PATENT DOCUMENTS

| | | | |
|---|---|---|---|
| DE | 2137693 | A | 2/1973 |
| DE | 2315077 | A | 10/1974 |

(Continued)

*Primary Examiner* — Thomas E Lazo

(74) *Attorney, Agent, or Firm* — Tomlinson McKinstry, P.C.

(57) ABSTRACT

A hydraulic control system for use with a work machine. The work machine has a platform which supports an operator. When the operator is not on the platform, the platform moves into a first position, causing a signal generator to send a signal to a controller. The controller is configured to limit the hydraulic flow to the ground drive motor when the platform is in the first position. The controller may directly reduce operation of the engine, or may adjust a valve which diverts a portion of hydraulic flow. The limitation may be overridden when desired by the operator.

20 Claims, 5 Drawing Sheets

(56) References Cited

U.S. PATENT DOCUMENTS

| | | | | |
|---|---|---|---|---|
| 5,147,010 | A | 9/1992 | Olson et al. | |
| 5,151,634 | A | 11/1992 | Ichihara et al. | |
| 5,348,115 | A | 9/1994 | Devier et al. | |
| 5,509,220 | A | 4/1996 | Cooper | |
| 5,544,055 | A * | 8/1996 | Cooper | B62D 11/183 701/50 |
| 5,553,407 | A | 9/1996 | Stump | |
| 5,564,455 | A | 10/1996 | Keating et al. | |
| 5,574,642 | A | 11/1996 | Cooper | |
| 5,590,041 | A | 12/1996 | Cooper | |
| 5,649,985 | A | 8/1997 | Stump | |
| 5,704,142 | A | 1/1998 | Stump | |
| 5,713,422 | A | 2/1998 | Dhindsa | |
| 5,746,278 | A | 5/1998 | Bischel et al. | |
| 5,768,811 | A | 6/1998 | Cooper | |
| 5,893,425 | A | 4/1999 | Finkle | |
| 5,913,371 | A | 6/1999 | Jeene | |
| 5,944,121 | A | 8/1999 | Bischel et al. | |
| 5,961,252 | A | 10/1999 | Mercer et al. | |
| 6,079,506 | A | 6/2000 | Mercer | |
| 6,119,376 | A | 9/2000 | Stump | |
| 6,195,922 | B1 | 3/2001 | Stump | |
| 6,226,588 | B1 | 5/2001 | Teramura et al. | |
| 6,237,711 | B1 | 5/2001 | Hunt | |
| 6,256,574 | B1 | 7/2001 | Prestl et al. | |
| 6,354,023 | B1 | 3/2002 | Trahan et al. | |
| 6,357,537 | B1 | 3/2002 | Runquist et al. | |
| 6,408,952 | B1 | 6/2002 | Brand et al. | |
| 6,408,960 | B1 | 6/2002 | Hidaka et al. | |
| 6,477,795 | B1 | 11/2002 | Stump | |
| 7,549,500 | B2 * | 6/2009 | Graham | E02F 9/2004 180/321 |
| 7,980,569 | B2 | 7/2011 | Azure et al. | |
| 8,113,306 | B2 * | 2/2012 | Mass | B62D 51/04 180/19.1 |
| 8,141,886 | B1 | 3/2012 | Sugden et al. | |
| 8,347,529 | B2 * | 1/2013 | Berg | E02F 5/145 37/348 |
| 8,371,048 | B2 | 2/2013 | Hartwick et al. | |
| 8,561,382 | B2 | 10/2013 | Gamble et al. | |
| 8,732,992 | B2 | 5/2014 | Hartwick et al. | |
| 9,066,468 | B2 | 6/2015 | Zwieg et al. | |
| 9,867,330 | B2 | 1/2018 | Dwyer | |
| 10,114,404 | B2 * | 10/2018 | Kukuk | A01D 34/82 |
| 10,144,404 | B2 | 12/2018 | Kukuk et al. | |
| 10,582,652 | B2 * | 3/2020 | Kukuk | E02F 3/088 |
| 2005/0102866 | A1 * | 5/2005 | Sewell | E02F 9/166 37/411 |
| 2020/0032480 | A1 * | 1/2020 | Kukuk | G05G 5/005 |
| 2020/0055536 | A1 * | 2/2020 | Carlson | E02F 9/02 |

FOREIGN PATENT DOCUMENTS

| | | | |
|---|---|---|---|
| DE | 3513750 | A1 | 10/1986 |
| EP | 0721052 | A2 | 7/1996 |
| GB | 2335450 | A | 9/1999 |
| WO | 88/02435 | A | 4/1988 |
| WO | 98/16712 | A | 4/1998 |
| WO | 00/66386 | A | 11/2000 |

* cited by examiner

THROTTLE CONTROL SYSTEM

SUMMARY

The present invention is directed to a work machine. The work machine comprises a chassis, a ground drive, a prime mover, a platform, and a control system. The ground drive translates the chassis across a ground surface. The prime mover is disposed on the chassis and configured to provide power to the ground drive. The platform is disposed on the chassis and movable from a first position to a second position. The control system comprises a signal generator, a throttle input, and a controller. The signal generator is configured to send a first signal. The throttle input is configured to send a throttle signal.

The controller is configured to receive the first signal and the throttle signal and provide an output throttle condition to the ground drive. A first condition is defined when the controller does not receive the first signal from the signal generator. In the first condition, the controller is configured to allow the throttle signal to determine the output throttle condition. A second condition is defined when the controller receives the first signal from the signal generator. In the second condition, the controller is configured to limit output throttle condition to a predetermined maximum.

In another aspect the invention is directed to a work machine. The work machine comprises a frame, a ground drive, a work attachment, a platform, a sensor, and a controller. The ground drive is supported on the frame. The work attachment is supported on the frame at a first end. The platform is supported on the frame at the second end and has a first position and a second position. The sensor is configured to determine the position of the platform and send a first signal when the platform is in the first position. The controller is in communication with the sensor and configured to limit the speed of the ground drive when the first signal is received.

In another aspect the invention is directed to a system for limiting hydraulic flow to a ground drive. The system comprises a signal generator, a controller, and a hydraulic circuit. The signal generator is configured to send a signal. The controller is in communication with the signal generator. The hydraulic circuit comprises a hydraulic pump and a ground drive motor. The ground drive motor powers a ground drive of a work machine. The controller is configured to limit flow from the hydraulic pump to the ground drive motor when the signal is received by the controller.

DETAILED DESCRIPTION

Figure 1:
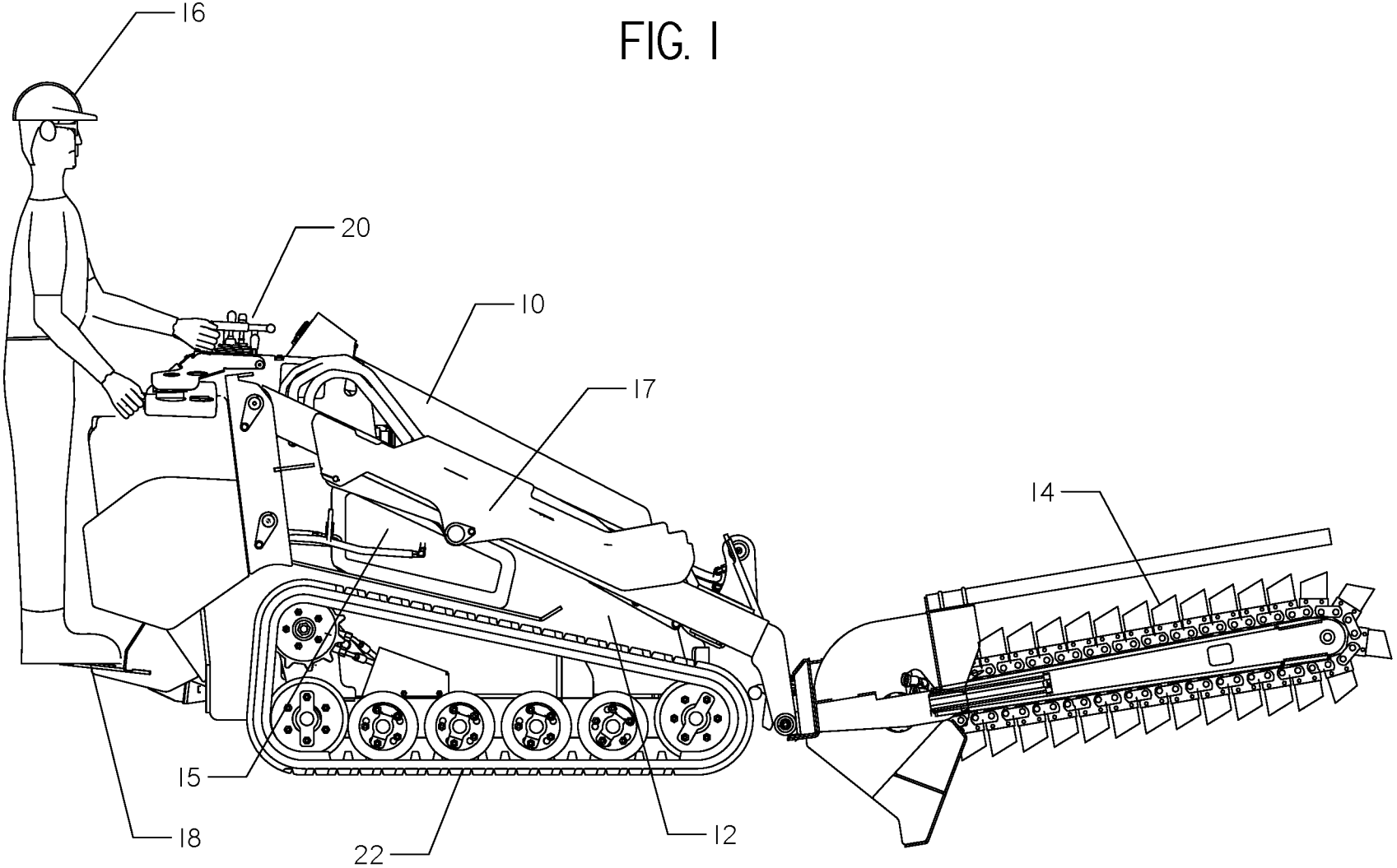
FIG. 1 is a side view of a work machine for use with a throttle control system. The work machine is shown with an operator on a rear platform and a trencher attachment.

Turning now to the figures, FIG. 1 illustrates a work machine 10. As described below, the work machine 10 utilizes a control system for providing a maximum speed or engine throttle given certain conditions detected by the system. In a first condition, the machine 10 operates as normally, controlled by an operator within the operational limitations of its engine. In a second condition, which may be initiated by a number of sensors, it is advantageous to provide a limit, keeping the ground speed or engine throttle below a threshold. For example, if the operator steps off of an operator platform, or a stall or slip condition is indicated, it may be advantageous to limit the throttle provided at the work machine. While the invention as described below is depicted for use on a trenching work machine 10, other machines may be utilized.

The work machine10 depicted comprises a chassis 12 and an attachment 14. The chassis supports an engine 15 to act as a prime mover for powering operative elements of the work machine 10. For illustrative purposes, the attachment 14 is a trenching chain on a trenching boom attached to loader arms 17. Other attachments, such as vibratory plows, buckets, microtrenching assemblies, or excavator arms may be utilized in conjunction with the chassis 12.

An operator 16 of the work machine 10 stands on a platform 18 located at a first end of the machine 10. A control panel 20 is positioned near and above the level of the platform 18 for the operator 16 to use. The control panel 20 comprises controls which operate the machine and control its associated attachment (FIG. 3).

The chassis 12 shown utilizes two powered tracks as a ground drive 22 system, but other ground engagement systems such as wheels, steerable track assemblies, or a combination of both could be employed based on the demands of the application.

Figure 2:
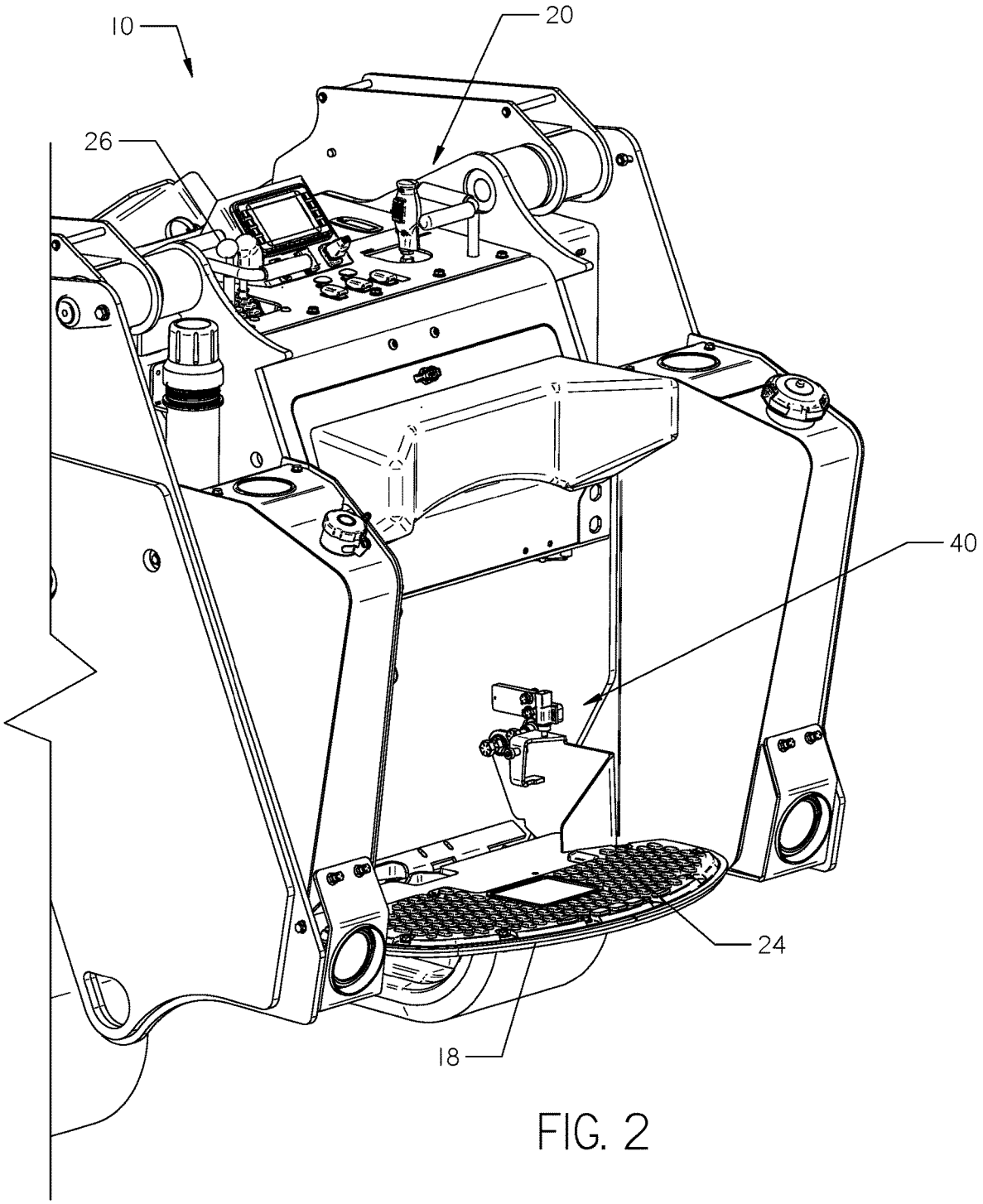
FIG. 2 is a top rear left perspective view of the work machine of FIG. 1, showing a platform switch for indicating the presence of an operator thereon.
Figure 3:
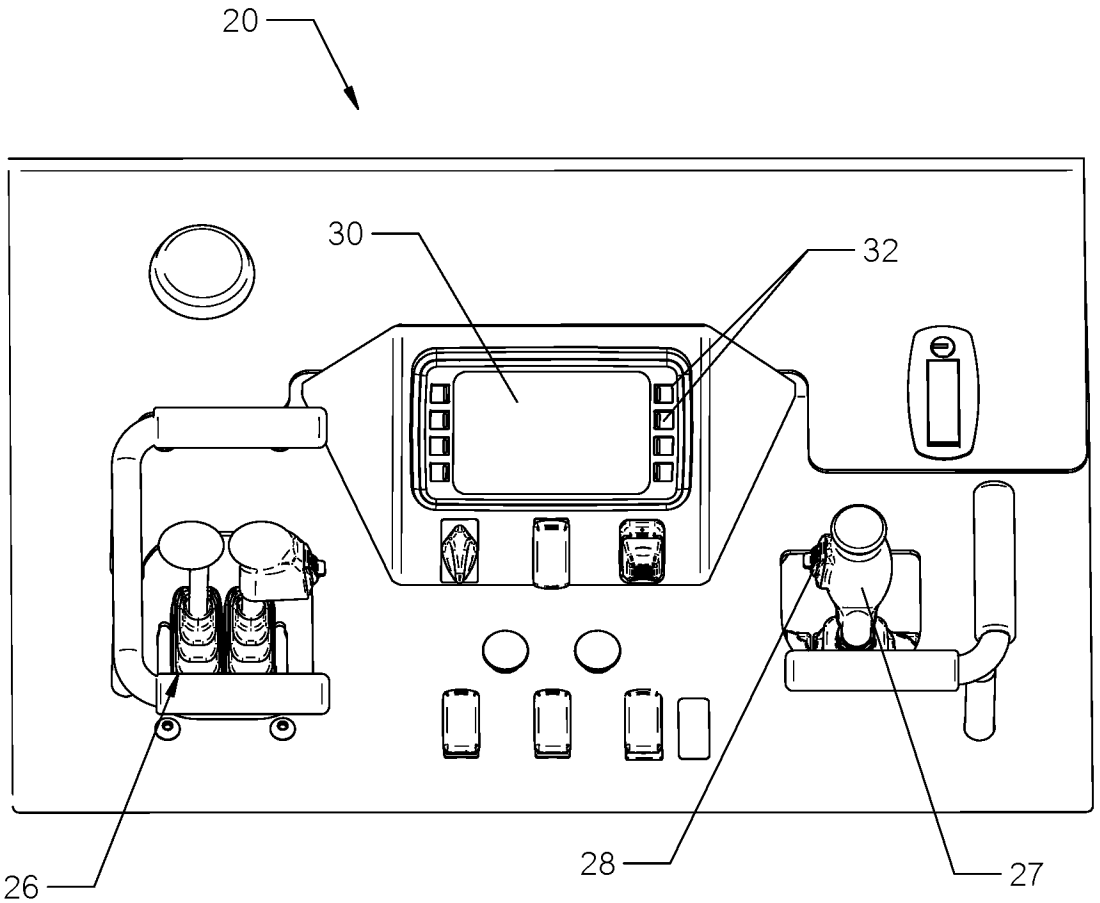
FIG. 3 is a top view of a control panel. Other elements of the work machine are not shown.

With reference now to FIGS. 2 and 3, the platform 18 may incorporate a treaded surface 24 to prevent the operator 16 (FIG. 1) from slipping off while the machine 10 is moving. The tracks (or other ground drive system 22) are controlled by at least one control lever 26, and is typically dual levers or a single joystick. As shown in FIG. 2, dual joysticks are utilized.

It is beneficial to provide a system to detect operator presence on the platform to ensure the safety of the operator 16 during operation. For example, when a trencher attachment 14 is active, a set of blades are rotated about the trencher boom to uncover a trench. The trencher attachment 14 may be configured to disengage upon the operator 16 dismounting the platform 18, thereby preventing the operator from approaching the active trencher. An operator presence system is provided in U.S. Pat. No. 10,582,652, issued to Kukuk, et al. ("Kukuk"), and is incorporated herein by reference.

In Kukuk, a platform switch, such as switch 40 (FIG. 2) is disclosed. The switch 40 detects the presence of an operator on the platform. A spring or compression system keeps the platform 18 biased to a first position. When the operator 16 is present on the platform, the operator's weight overcomes this bias and maintains the platform 18 in a second position. The platform switch 40 may be positioned either on or adjacent the platform to send a signal to a controller indicative of whether the platform is in the first or second position.

Figure 4:
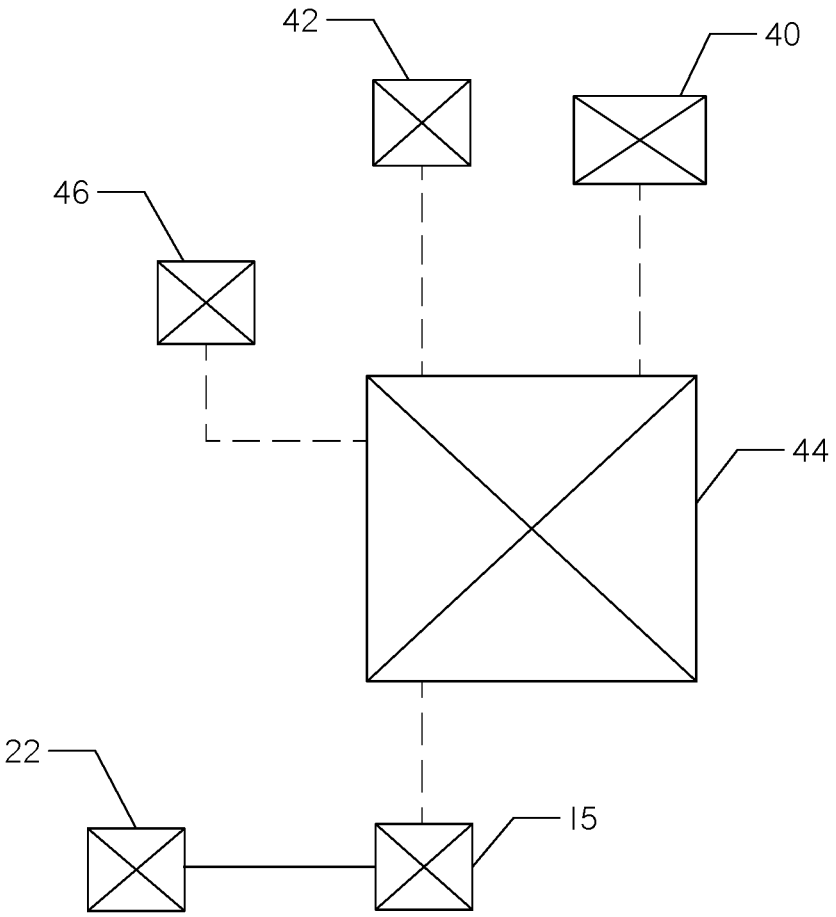
FIG. 4 is a block diagram of a control system for a work machine. The controller is shown directly manipulating the speed of a prime mover.

With reference to FIG. 4, the present invention utilizes the platform switch 40 as provided in Kukuk to provide a signal that determines a maximum position for the throttle of the engine 15 or speed of the work machine 10. The work machine 10 comprises an engine control unit (ECU) 42, controller 44, a signal generator located at the platform switch 40, and an operator input 46. The ECU 42 controls the engine's throttle by utilizing an electronic throttle control system. The operator 16 may use the operator input 46 to send a signal to the controller 44, which instructs the ECU 42 to throttle the engine up or down.

With reference again to FIG. 4, the platform switch 40 is continuously monitored by the controller 44 to see if a signal is transmitted. When the platform 18 is in the second position, indicating that the operator 16 is standing on the platform, the full range of throttle, as directed by the operator input 46, is available to the work machine 10. When the platform 18 is in the first position, indicating that the operator 16 is not on the platform, the controller 44 is configured to send a signal to the ECU 42, setting a lower throttle limit.

The operator input 46 may be buttons, a touchscreen display, switch, or lever, such as the control levers 26. Various controls are shown on FIG. 3. As shown, a display 30 and a plurality of buttons 32 are located on the control panel. A first button under the display signals the ECU 42 to increase a maximum throttle setpoint. An adjacent second button signals the ECU 42 to decrease the maximum throttle setpoint. The controller 44 controls a variety of work machine 10 functions such as the hydraulic system and ground drive. The controller 44 may be a separate unit or an integrated unit with the display 30.

In some cases the operator 16 may prefer to operate the ground drive 22 of the machine 10 without standing on the platform 18. For example, the operator 16 may wish to stand to the side of the machine 10 and operate the controls while loading the machine onto a trailer. When the platform 18 is unoccupied in and the first position, the ECU 42 may limit the maximum speed of the ground drive 22 through limiting the power supplied by the engine 15.

Once the operator 16 steps back on the platform 18, the platform 18 will move from the first position to the second position. The controller 44 may then instruct the ECU 42 to allow full range of throttle. The controller 44 may also be configured to detect and store in memory the throttle level setpoint at the point in time that the platform moves from the second position to the first position. The controller 44 may then instruct the ECU 42 to return the engine throttle level to the recorded setpoint upon the operator 16 stepping back on the platform 18. In this case, the ECU 42 may slowly increase the throttle level to prevent a sudden or unexpected jump in the operation of the work machine 10.

Figure 5:
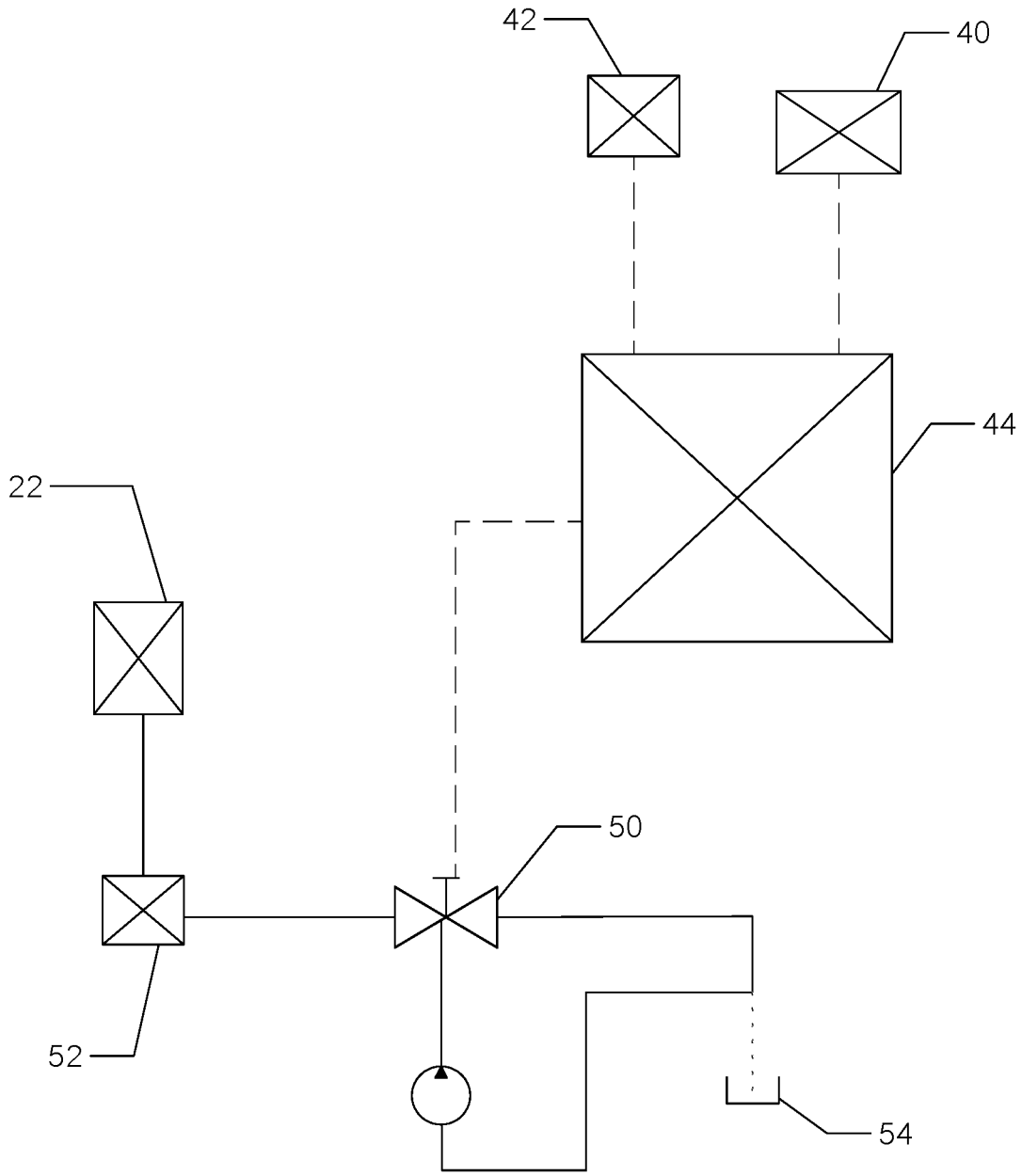
FIG. 5 is a block diagram of a control system of a work machine. The controller is shown adjusting a proportional pressure reducing valve to divert hydraulic flow from a prime mover, thereby reducing power to a drive system without reducing engine speed.

As shown in FIG. 5, a proportional pressure reducing (PPR) valve 50 is provided to directly limit ground drive 22 speed without reducing the engine's rpm. Like the system above, the platform switch 40 is in communication with the controller 44. The switch 40 sends a signal indicating whether the platform 18 is in the first or second position.

Ordinarily, the pilot steering valve 52 is directly actuated by an operator input, such as control lever 26 (FIG. 3). When the platform 18 is in the second position, the entire hydraulic flow is allowed to be controlled at the pilot steering valve 52, operating the speed of the ground drive 22.

When the platform 18 is in the first position, indicating the operator 16 has stepped off the platform, the PPR valve 50 is activated by the controller 44. The PPR valve 50 then reduces the hydraulic flow provided to the pilot steering valve 52 to a lower value. This may occur by diverting hydraulic flow exceeding the maximum value back to a fluid reservoir 54.

As a result, the valve assembly 50 provides the hydraulic motors controlling the tracks or other ground engagement system 22 with a lower maximum fluid flow, even as the lever 26 controlling the pilot steering valve 52 (and thus the ground speed) is moved fully forward or aft.

For example, if the controller 44 is set to limit the PPR valve 50 to twenty percent of maximum throttle upon the platform moving to the first position, the lever 26 is able to increase the hydraulic flow at lever positions corresponding to zero through twenty percent power. However, after exceeding twenty percent, excess hydraulic flow through the PPR valve 50 is diverted to the reservoir 54. In this example, only twenty percent of the maximum power can ever be indicated by the PPR valve 50 (as actuated by the lever 26), and the hydraulic flow to the ground drive 22 does not increase further.

This embodiment has the advantage of limiting the work machine's maximum speed without affecting the engine throttle level, if so desired. Such a system has practical implications. For example, an operator 16 may wish to use the attachment 14, for example, a bucket, to lift heavy material. In order to fine-tune this placement, it may be advantageous to step off the platform 18 and to the side of the work machine 10. In this scenario, the engine 15 fully powers the attachment 14 to keep a load elevated, while the PPR valve 50 limits hydraulic flow to the ground drive, and thus ground drive speed, when the platform is in the first position.

There may be scenarios in which an override of the platform switch 40 is necessary. For example, in extreme conditions the work machine 10 may become stuck in mud, such that the platform 18 is lifted to the first position even when an operator 16 is standing on the platform. In this case, an override is needed to communicate to the controller 44 to allow the full range of throttle or speed. Preferably, a button or switch is provided which, when initiated, instructs the controller 44 to override the normal operational parameters. The override may be configured such that it would not be available to actuate unless the operator is standing on the platform.

The work machine 10 shown comprises a loader lever 27 (FIG. 3) with an attachment switch 28. The loader lever 27 controls loader arms 17. The attachment switch 28 is preferably infinitely variable and, under normal circumstances, may be configured to vary the hydraulic flow to the attachment 14. If it becomes necessary to override the platform switch 40, a button or setting could be triggered to put the controller into override mode. This allows the attachment switch 28 to be used as a platform switch 40 override. While in override mode, the attachment switch 28 will no longer control hydraulic flow to the attachment 14. The operator may now control the throttle directly using the attachment switch 28. During override conditions, it is advantageous to prevent hydraulic flow to, and operation of, the attachment 14.

The attachment switch 28 is biased to an idle position. Therefore, the operator 16 must keep constant contact with the switch 28 to maintain an increased throttle level while in override mode. While in override mode, the loader lever 27 will continue to operate the control loader arms 17 as normal. The control levers 26 are also biased to a neutral position, requiring the operator to maintain continuous force on the control levers to move the machine. If the control levers 26 comprise a cruise control, the controller will not allow cruise mode to be activated if the platform 18 is in the first position regardless of whether the override mode is activated.

It may be preferable to implement throttle control for limiting hydraulic flow to the ground drive system 22 for other purposes. For example, if the platform 18 moves from the second position to the first position, the controller 44 may instruct the ECU 42 to idle the engine. Simultaneously, the controller 44 may instruct the PPR valve 50 to limit hydraulic flow to the pilot steering valve to a specified reduced pressure.

The ECU 42 continuously monitors the rpm of the engine, which in turn may communicate this information to the controller 44. The controller 44 may instruct the ECU 42 to increase the throttle level to maintain rpm within a specified range, for example, 1100 to 1300 rpm, while limiting the pressure available to the pilot steering valve 52. The speed of the ground drive 22 will therefore continue to be limited to within the specified range safe for pedestrian use while preventing the engine from stalling. Alternatively, the controller may instruct the PPR valve 50 to reduce flow to the pilot steering valve 52 in response to the rpm level in the engine dropping below a specified level.

The described system may also be used to provide engine anti-stall regardless of the mode of operation. When the platform 16 is in the second position, the controller 44 may utilize a variety of inputs to control the pilot steering valve 52 pressure via the PPR valve 50. Inputs may include engine load, ground drive speed and engine speed. These inputs act as a signal generator, to instruct the controller as to adverse conditions. The controller 44 can determine the maximum hydraulic pressure to allocate to the pilot steering valve 52 without stalling the engine.

If the engine is undergoing excessive engine load above a predetermined setpoint, the controller 44 will instruct the PPR valve 50 to restrict flow to the pilot steering valve 52 to a lower level to reduce the load. Flow is restricted by starting from the current maximum allowed flow and decreasing flow until engine load decreases. Once engine load decreases to an acceptable level, flow to the pilot steering valve will stabilize and may thereafter increase.

A threshold value may be assigned representing the engine load with respect to a particular ground drive 22 speed and engine speed. The controller 44 may continuously monitor and adjust the threshold value. So long as the engine load is below the threshold value assigned, the controller will instruct the PPR valve 50 to direct a maximum allowed flow to the pilot steering valve 52. If the engine 15 load is at or above the threshold value, the PPR valve 50 redirects flow away from the pilot steering valve 52 as described.

The disclosed engine anti-stall system may be particularly beneficial while traversing a steep incline. While traversing the incline the ground drive 22 speed would be limited. The anti-stall system would also be beneficial at the minimum engine speed while loading the machine 10 on a trailer for transport. There are some conditions at low engine speed and high load that could cause the machine to stall at a critical loading point.

The anti-stall system could also be used in conjunction with a ground drive speed sensor to prevent track or wheel slippage. The controller 44 monitors the ground drive 22 speed in conjunction with the engine load and engine speed to determine slippage. For example, a sudden spike in ground drive speed coupled with a decrease in engine load may indicate track slippage. To prevent further slippage, the controller may instruct the PPR valve 50 to progressively divert flow away from the steering valve 52 until slippage is no longer sensed. Once traction is regained, an increase in flow to the pilot steering valve 52 may be reintroduced.

Changes may be made in the construction, operation and arrangement of the various parts, elements, steps and procedures described herein without departing from the spirit and scope of the invention as described in the following claims.

The invention claimed is:

1. A work machine comprising:
- a chassis;
- a ground drive for translating the chassis across a ground surface;
- a prime mover disposed on the chassis and configured to provide power to the ground drive;
- a switch disposed on the chassis, wherein the switch is adjustable from a first position to a second position; and
- a control system, comprising:
  - a throttle input configured to send a throttle signal;
  - a controller configured to receive the throttle signal and provide an output throttle condition to the ground drive; whereby:
    - a first condition is defined when the switch is in the first position, in which the controller is configured to allow the throttle signal to determine the output throttle condition; and
    - a second condition is defined when the switch is in the second position, in which the controller is configured to limit output throttle condition to a predetermined maximum such that the prime mover is in an idle condition when the controller is in the second condition.

2. The work machine of claim 1 in which the switch is configured to be actuated by an operator foot.

3. The work machine of claim 1 further comprising:
- an attachment attached to the chassis, wherein the prime mover is configured to provide power to the attachment; and
- an attachment switch, wherein the attachment switch is configured to maintain an override condition wherein the controller is in the first condition and the switch is in the second position.

4. The work machine of claim 3 in which the throttle control comprises the attachment switch when the attachment switch is in the override condition.

5. The work machine of claim 1 in which the throttle input comprises a control lever.

6. A method of operating a work machine having a ground drive and an attachment, comprising:
- placing the work machine in a first condition by standing on a platform, wherein the first condition is characterized by the operation of a throttle control to control operation of the ground drive and the attachment;
- thereafter, stepping off the platform to place the work machine into a second condition, wherein the second condition is characterized by a predetermined maximum throttle output;
- in which an engine of the work machine is placed into an idle condition when the work machine is in the second condition.

7. The method of claim 6 further comprising:
- operating the ground drive and the attachment with a throttle control;
- placing the work machine into an override condition;
- thereafter, stepping off the platform;
- limiting the functions of the work machine when in the override condition and the operator is off the platform.

8. The method of claim 7 wherein the step of limiting the functions of the work machine comprises preventing hydraulic flow to the attachment.

9. The method of claim 7 wherein the step of limiting the functions of the work machine comprises maintaining continuous force on the throttle control while in the override mode.

10. The method of claim 6 in which the work machine comprises a proportional pressure reducing valve, wherein hydraulic fluid is redirected from operation of the ground drive when the machine is in the second condition.

11. A work machine comprising:

a chassis;

a ground drive for translating the chassis across a ground surface;

a prime mover disposed on the chassis and configured to provide power to the ground drive;

a foot switch disposed on the chassis, the foot switch movable from a first position to a second position;

a control system, comprising:

a throttle input configured to send a throttle signal;

a signal generator configured to send a foot switch signal indicative of the first position or the second position;

a controller configured to receive the foot switch signal and the throttle signal and provide an output throttle condition to the ground drive; whereby:

a first condition is defined when the foot switch is in the first position, in which the controller is configured to allow the throttle signal to determine the output throttle condition; and a second condition is defined when the foot switch is in the second position, in which the controller is configured to limit output throttle condition to a predetermined maximum; and an override in communication with the controller, in which the override is configured to maintain the controller in the first condition when the foot switch signal is in the second position.

12. A method of using the apparatus of claim 11, comprising:

standing on the foot switch, thereby placing the foot switch in the first position;

operating the ground drive with the throttle input with the controller in the first condition;

thereafter, stepping off the platform, thereby placing the foot switch in the second position;

thereafter, operating the ground drive with the throttle input with the controller in the second condition.

13. A method of using the apparatus of claim 11, wherein the apparatus further comprises an attachment powered by the prime mover, and comprising:

standing on the foot switch, thereby placing the foot switch in the first position;

operating the ground drive with the throttle input with the controller in the first condition;

activating the override;

thereafter, stepping off the foot switch, placing the foot switch in the second position while the override is activated; and while the foot switch is in the second position and the override is activated, operating the work machine in the first condition.

14. The method of claim 13 wherein the step of operating the work machine in the first condition comprises operating the attachment.

15. The method of claim 13 in which the override comprises an infinitely variable attachment switch.

16. The apparatus of claim 11 in which the override comprises an infinitely variable attachment switch.

17. The apparatus of claim 11 in which the foot switch comprises a platform.

18. The apparatus of claim 11 further comprising a proportional pressure reducing valve configured to divert hydraulic flow away from the ground drive when the controller is in the second condition.

19. A work machine comprising:

a ground drive;

a frame supported by the ground drive;

an attachment supported by the frame;

a foot switch disposed at an end of the frame, the foot switch movable between a first position and a second position; and a system for limiting hydraulic flow to the ground drive and the attachment, comprising:

a signal generator configured to send a signal indicative of the position of the foot switch;

a controller in communication with the signal generator;

in which the controller is configured to restrict operation of the ground drive when the signal is received by the controller; and an override configured to allow unrestricted operation of the attachment when the signal is received by the controller.

20. The work machine of claim 19 wherein:

the controller is configured to reduce the operation of the hydraulic pump when the signal is received by the controller.

* * * * *